US008136968B2

(12) United States Patent
Chiu

(10) Patent No.: US 8,136,968 B2
(45) Date of Patent: Mar. 20, 2012

(54) APPARATUS FOR ATTACHING A SHADE OR SKIRT TO A HANGING LIGHT FIXTURE

(75) Inventor: Kam P Chiu, Toronto (CA)

(73) Assignee: Glow Lighting Inc., Markham, Ontario (CA)

( * ) Notice: Subject to any disclaimer, the term of this patent is extended or adjusted under 35 U.S.C. 154(b) by 242 days.

(21) Appl. No.: 12/507,852

(22) Filed: Jul. 23, 2009

(65) Prior Publication Data

US 2010/0027280 A1 Feb. 4, 2010

(30) Foreign Application Priority Data

Jul. 25, 2008 (CA) ..... 2638301
Jul. 19, 2009 (CA) ..... 2672573

(51) Int. Cl.
*F21V 21/36* (2006.01)

(52) U.S. Cl. ..... 362/403; 362/357; 362/358; 362/407

(58) Field of Classification Search ..... 362/351, 362/355–358, 403–404, 407–408, 433–434, 362/437–442, 449, 451
See application file for complete search history.

(56) References Cited

U.S. PATENT DOCUMENTS 1,490,283 A * 4/1924 Loeffelholz ..... 362/359
2,340,710 A * 2/1944 Terr ..... 362/433

* cited by examiner

*Primary Examiner* — Jason Moon Han
(74) *Attorney, Agent, or Firm* — Kusner & Jaffe

(57) ABSTRACT

Apparatus to attach a shade or skirt to a hanging light fixture without the need to detach the fixture from the ceiling and/or to disassemble the body of the fixture, the apparatus having an upper retaining means, a height adjustment means and a plurality of support means having a first end connected to the shade or skirt, said shade or skirt having a covered peripheral frame defining an open interior and another end connected to the upper retaining means.

8 Claims, 8 Drawing Sheets

APPARATUS FOR ATTACHING A SHADE OR SKIRT TO A HANGING LIGHT FIXTURE

FIELD OF THE INVENTION

The present invention relates generally to apparatus designed to attach a shade or skirt to any hanging fixture without the need to detach the fixture from the ceiling and/or to disassemble the body of the fixture.

BACKGROUND OF THE INVENTION

A conventional shade for a hanging fixture has a wire peripheral frame covered by fabric and a plurality of spokes extending horizontally and radially inwardly from the peripheral frame meeting at a central ring. The central ring may or may not be notched to permit the central ring to encircle and rest on the fixture loop.

In order to attach the shade, the installer is required to first completely remove the fixture from the ceiling. The shade is then attached to the fixture in one of two ways. If the spokes and ring of the shade are to rest on the top of fixture, the fixture loop on the top of the fixture is inserted through the notch on the ring. Otherwise the body of the fixture, where components can be separated must be disconnected or loosened, and then the shade is inserted. Once the shade is inserted the installer reassembles, tightens, all the loosened parts of the fixture then reattaches the fixture and attached shade back to the ceiling.

There are a number of problems with the design of this type of shade and its method of installation. First the method is very time consuming and costly. If the shade is installed with the spokes and ring resting on the top of the fixture, the shade doesn't sit right because the area where it rests needs to be flat and horizontally leveled. Most fixtures have a fixture loop which is oval or round, preventing the shade from sitting properly. In addition the placement of the shade at this height may not be at a location that is pleasing to the eye.

If the placement of the shade is anywhere else along the fixture, then disassembling the fixture to allow fitting over/thru the spokes and ring will be required. The placement of the spokes and ring depend on whether the fixture components can be separated. The separation is limited to a few millimeters as any separation more than a few millimeters apart may cause the fixture to fall down. Generally, the gap is too small to fit the spokes and ring without sacrificing the safety of the fixture or fulfilling the standard requirements of CSA and/or UL.

Further the manufacturing or assembling of most fixtures starts from the bottom of the body and works its way to the top. With each section, there are securing nuts and bolts hidden inside to hold the body in place. Therefore, the proper method of disassembling a fixture should work from the top down, taking one component apart, one at a time. If this procedure is not followed, the inside becomes loosened, making re-fastening very difficult. Once again, safety will be an issue. In addition, most products, once taken apart, will void any manufacturers warranty.

SUMMARY OF THE INVENTION

The present invention relates to apparatus to attach a shade or skirt to a hanging light fixture, the apparatus having an upper retaining means, a height adjustment means and a plurality of support means each having a first end connected to the shade or skirt and a second end connected to the upper retaining means. The upper retaining means is attachable around a portion of the fixture connecting the fixture to a junction box in the ceiling without the need to detach the fixture from the ceiling and/or to disassemble the body of the fixture.

In an other aspect the present invention relates to a method of attaching a shade or skirt to a hanging light fixture without the need to detach the fixture from the ceiling and/or to disassemble the body of the fixture, the fixture connected to junction box in a ceiling by means of chain having one end attached to a screw loop threaded over the end of a threaded rod projecting through a canopy and the other end of the threaded rod secured to the junction box, the other end of the chain connected to a fixture loop on the top of the light fixture, the method including the following steps:

(a) loosening the top loop slightly to permit an upper retaining means having a peripheral wall defining a centrally disposed opening, said opening open through a side of the peripheral wall, to be inserted between the top loop and a bottom surface of the canopy where the threaded rod fits into the opening in the peripheral wall then tightening the top loop;

(b) a first end of each of a plurality of support means is passed through one of a plurality of holes in the upper retaining means and the second end of the plurality of support means is secured to the upper retaining means;

(c) the first end of each of the plurality of support means is then fed through one of a plurality of guide holes on a height adjust means;

(d) the first end of the plurality of support means is attached to the shade positioned to encircle the light fixture; and (e) providing a shade having a peripheral frame covered with fabric defining an interior of the shade, the interior of the shade is open throughout its height so it can be placed in position around the light fixture without detaching or disassembling the fixture and wherein at points adjacent a top edge of the shade are means for securement of a first end of the plurality of support means to the shade;

(f) then leveling the shade and leveling and positioning the height adjustment means to position the shade at the desired location relative to the light fixture.

BRIEF DESCRIPTION OF THE DRAWINGS

An embodiment of the invention is shown in the drawings, wherein.

DETAILED DESCRIPTION OF THE PREFERRED EMBODIMENTS

Figure 1:
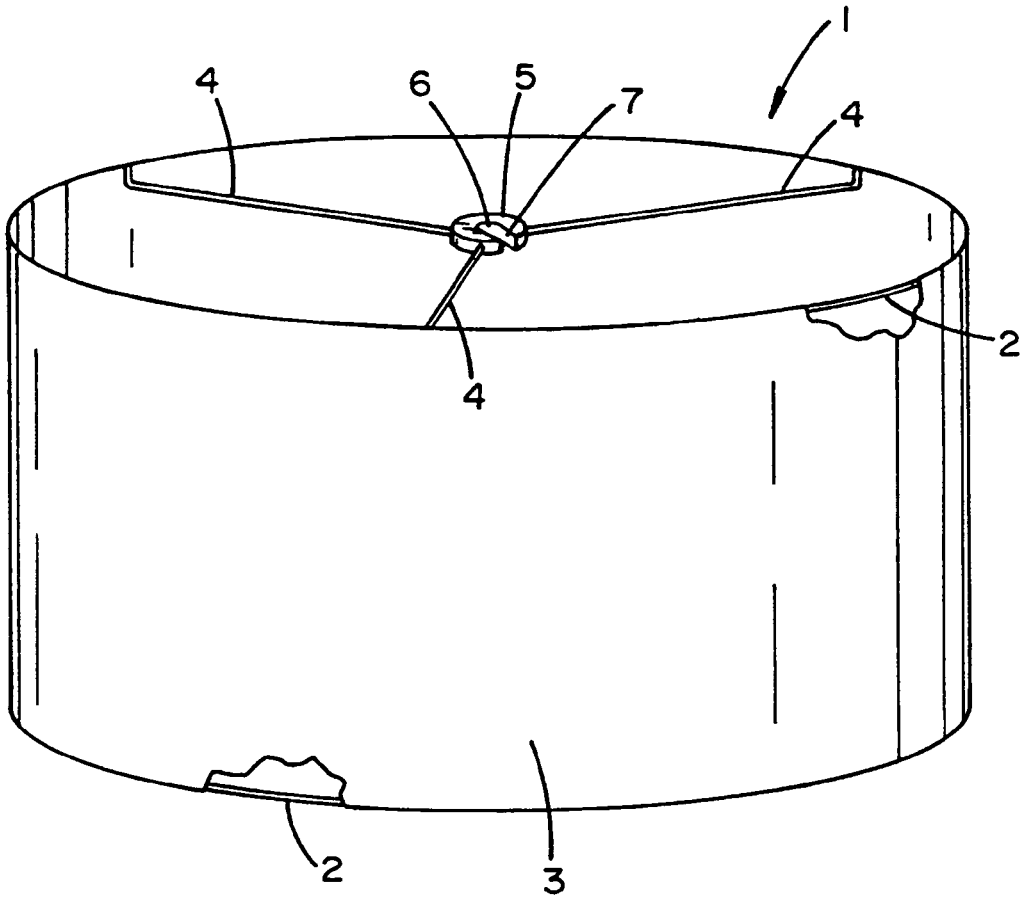
FIG. 1 (PRIOR ART)
FIG. 1 illustrates a prior art shade with a peripheral frame covered with fabric and a plurality spokes extending horizontally and radially inwardly from the peripheral frame meeting at a central ring.

FIG. 1 illustrates a prior art shade, generally indicated at 1, for a hanging fixture, the shade 1 having a peripheral frame 2 covered with fabric 3 and a plurality of spokes 4 extending horizontally and radially inwardly from the peripheral frame 2 meeting at a central hub 5. The central hub 5 has a central disposed opening 6 and a notch 7. Typically the shade is attached to the fixture by having the central hub 5 rest on top of or just below a fixture loop at the top of the fixture. As noted above installation is difficult, time consuming and costly.

Figure 2:
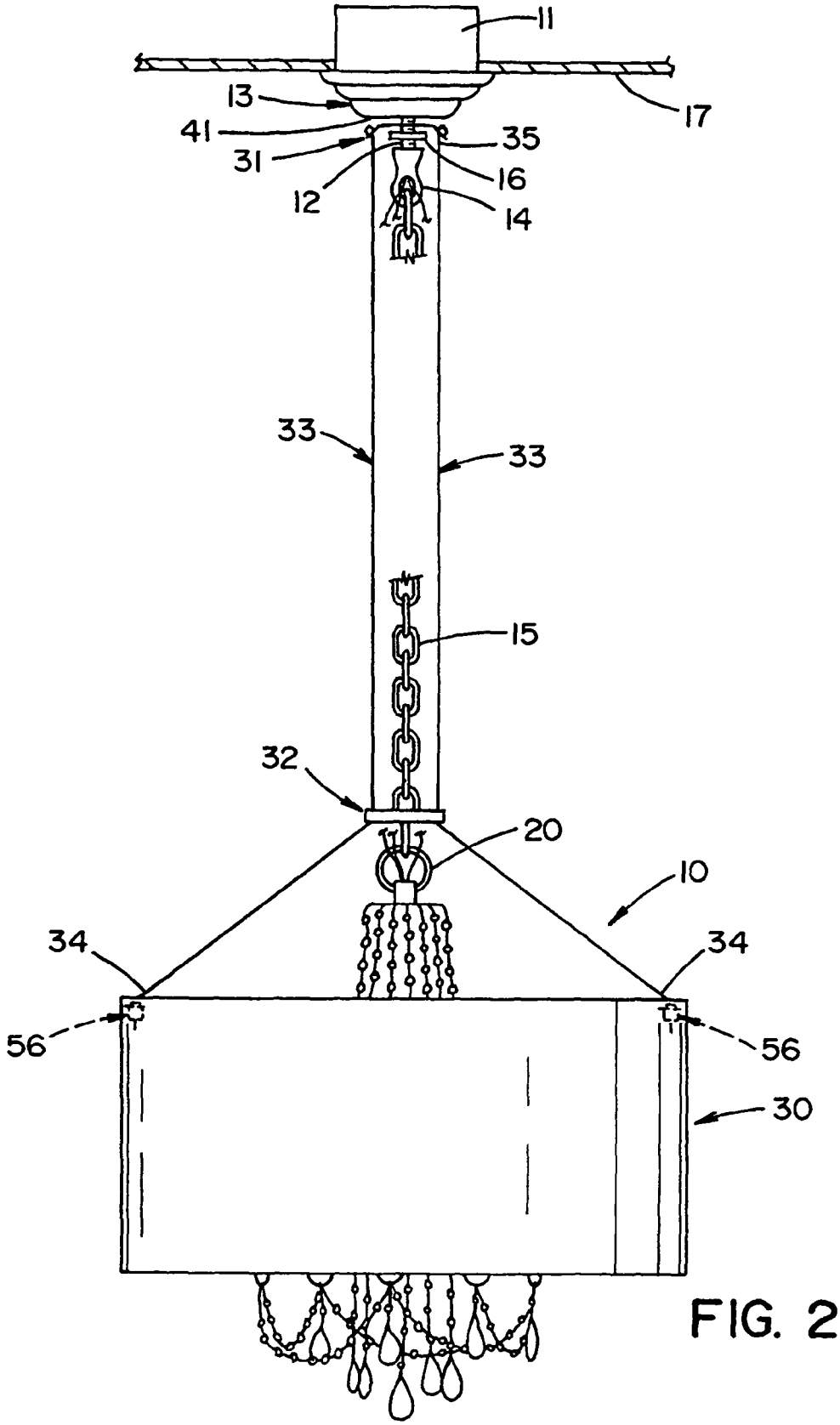
FIG. 2 illustrates a hanging light fixture together with one embodiment of apparatus attaching a shade in accordance with the present invention, the apparatus having an upper retaining means, a height adjustment means and a plurality of support means each having a first end connected to the shade and a second end connected to the upper retaining means.

FIG. 2 illustrates a hanging light fixture, generally indicated at 10, attached to a junction box 11 in ceiling 17. The fixture 10 is connected to junction box 11 in a conventional manner. Typically a cross bar is attached to the bottom of the junction box by screws or bolts. A threaded rod 12 is retained on the cross bar and locked in place with lock nuts. The threaded rod 12 fits through a canopy 13. A top loop 14 threads over the exposed end of the threaded rod 12 to hold the canopy 13 in place. A chain 15 attached to top loop 14 connects to the fixture loop 20 on the top of fixture 10, a chandelier in the embodiment illustrated.

A shade, custom designed for use with the present invention, generally indicated at 30 is shown attached to the fixture 10 by apparatus according to one embodiment of the present invention. The apparatus of the present invention consists of an upper retaining means generally indicated at 31, a height adjustment means 32 and a plurality of support means, generally indicated at 33, having a first end 34 connected to the shade or skirt 30 and a second end 35 connected to the upper retaining means 31.

Figure 3:
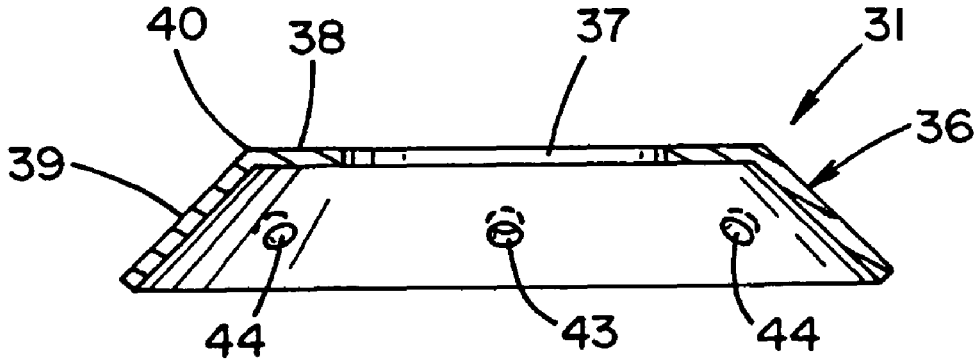
FIG. 3 is a side view in cross-section of the upper retaining means of the apparatus of FIG. 2.
Figure 4:
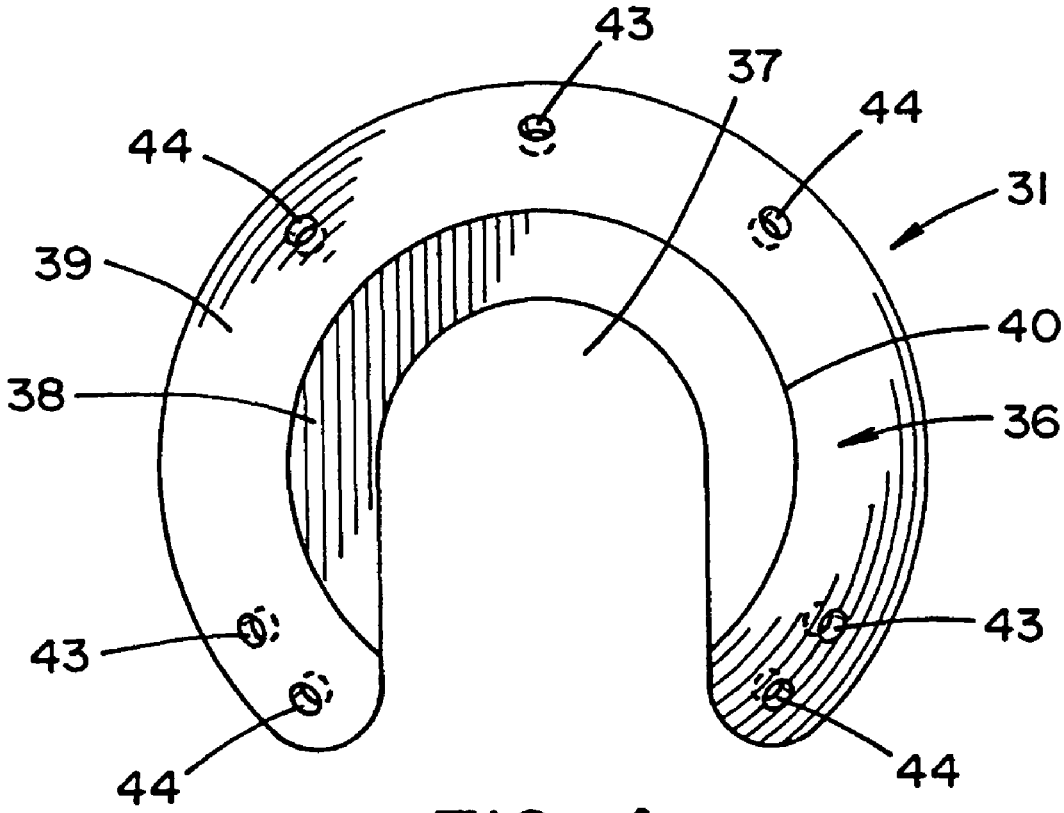
FIG. 4 is a top plan view of the upper retaining means of FIG. 3.

As best shown in FIGS. 2-4, the upper retaining means 31, in the embodiment illustrated, is disc like having a peripheral wall 36 defining a centrally disposed opening 37. In the embodiment illustrated the peripheral wall 36 is generally circular and the opening 37 is U-shaped, open through a side of the peripheral wall 36. As best seen in FIGS. 2 and 3, the peripheral wall 36 of the upper retaining means 31 illustrated has a flat, three quarters moon shaped section 38. A depending peripheral flange 39 extends around the outer edge 40 of section 38.

The upper retaining means 31 is sized and shaped to be inserted around threaded rod 12 between the outer surface 41 of canopy 13 and top loop 14. To attach the upper retaining means loosen the top loop 14 slightly or as shown in FIG. 2, loosen a screw ring 16 provided between top loop 14 and the upper retaining means 31. The threaded rod 12 fits into the opening 37 in peripheral wall 36 and then the screw ring 16 and top loop 14 are tightened. A plurality of holes is provided in flange 39 and the holes are located for attachment of one end 35 of each of the plurality of support means 33.

In the embodiment illustrated, the upper retaining means 31 is provided with two sets of holes. The first set comprises three holes 43 located equidistant around the flange 39. This set is used for shades where the plurality of support means consists of three wires. The second set comprises four holes 44 located equi-distant around the flange 39. This set is used for shades where the plurality of support means consists of four wires.

Figure 5:
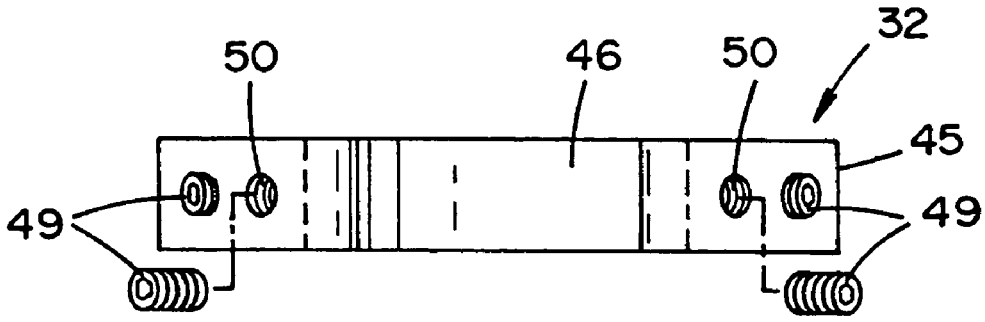
FIG. 5 is a side plan view of the height adjustment means of the apparatus of FIG. 2.
Figure 6:
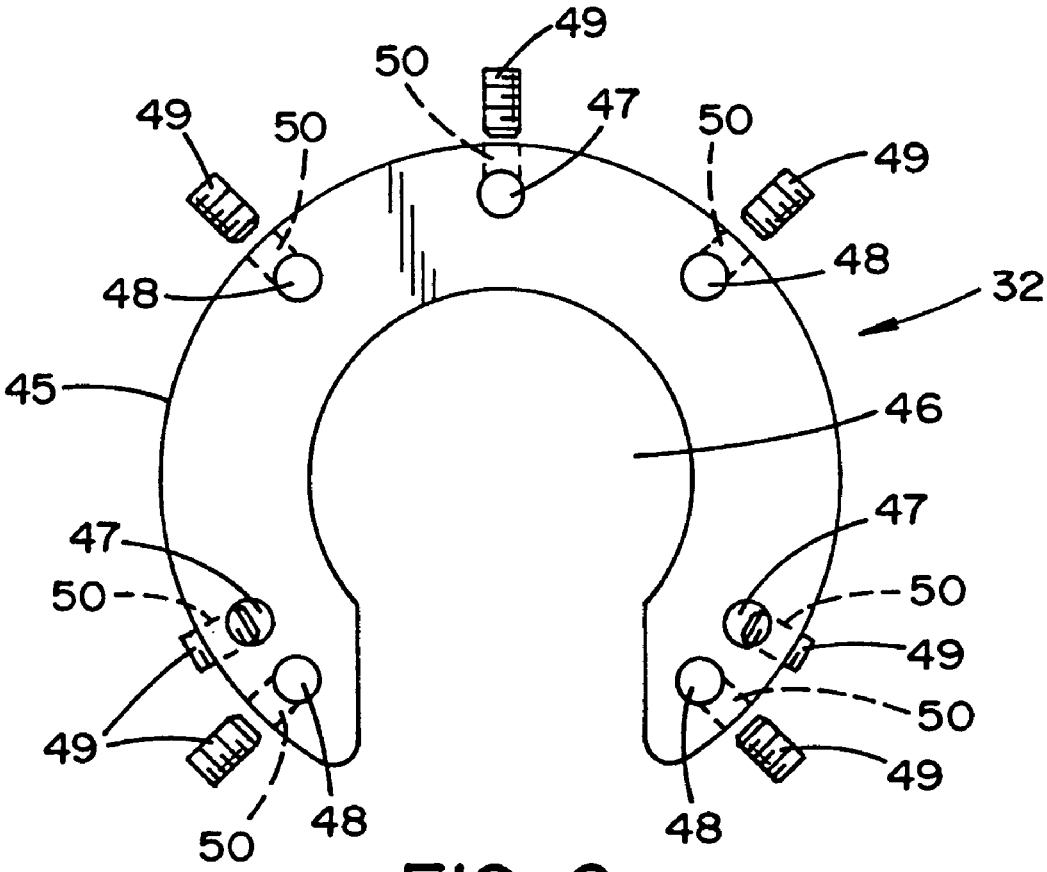
FIG. 6 is a top plan view of the height adjustment means of FIG. 5.

Referring to FIGS. 2, 5 & 6, the height adjustment means 32, in the embodiment illustrated, has a peripheral wall 45 defining a centrally disposed opening 46. In the embodiment illustrated the peripheral wall 45 is generally circular and the opening 46 is U-shaped, open through a side of the peripheral wall 45. The height adjustment means 32 is sized and shaped to fit around chain 15 above the fixture 10. A plurality of holes is provided in peripheral wall 45 and the holes are located to allow one of the plurality of support means 33 to pass through before connection to the shade. The height adjustment means 32 purpose is to center and to level the shade.

As best shown in FIGS. 5 & 6, the height adjustment means 32, in the embodiment illustrated, is provided with two sets of holes. The first set comprises three holes 47 located equidistant around the peripheral wall 45. This set is used for shades where the plurality of support means consists of three wires. The second set comprises four holes 48 located equidistant around the peripheral wall 45. This set is used for shades where the plurality of support means consists of four wires. Screws 49 can be tightened in holes 50 in the side wall of peripheral wall 46 and that open in to holes 47, 48 to lock the height adjustment means 32 in the desired location on the plurality of support means 33.

Figure 7:
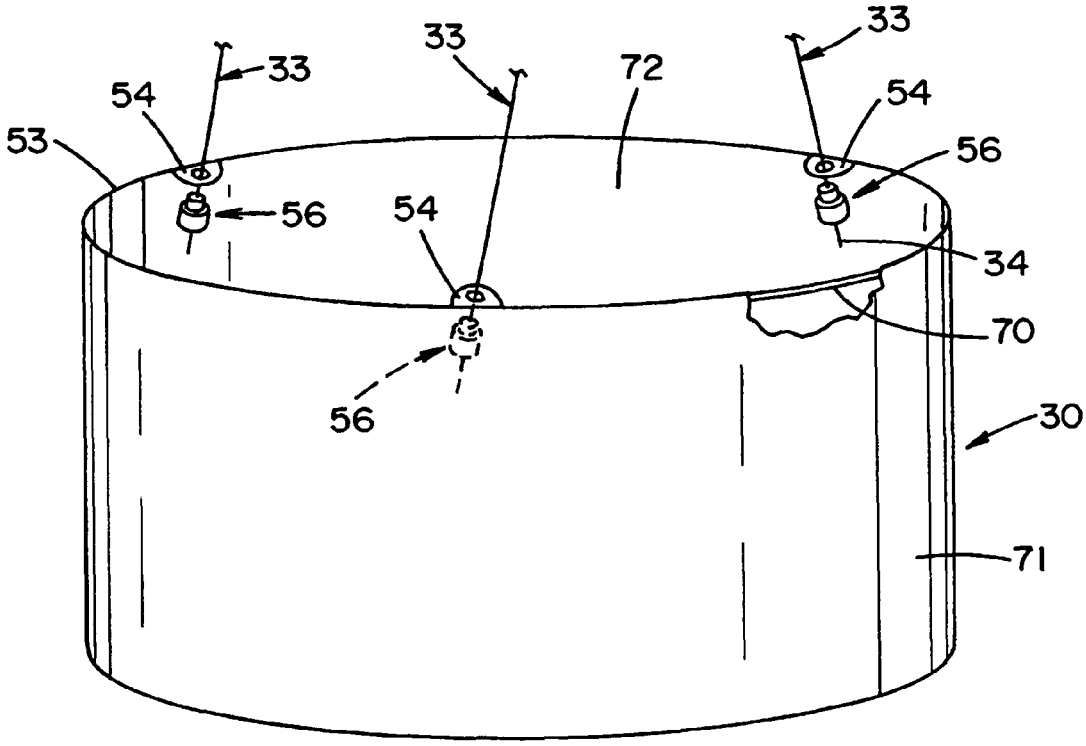
FIG. 7 shows a custom shade for use with the embodiment of the invention of FIG. 2 and a means for connecting a second end of each of the plurality of support means to the shade.
Figure 8:
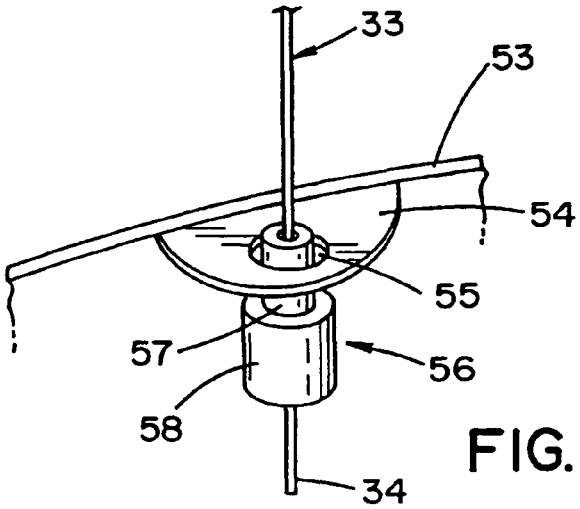
FIG. 8 shows an enlarged view of the means for connecting a second end of each of the plurality of support means to the shade of FIG. 7.

Referring to FIG. 7, a custom shade 30 for use with the embodiment of the invention of FIG. 2 and means, generally indicated at 69, for connecting a first end 34 of each of the plurality of support means 33 to the shade 30 are illustrated. The shade 30 has a peripheral frame 70 covered with fabric 71. Unlike the prior art shade of FIG. 1. It is not provided with a plurality of spokes extending horizontally and radially inwardly from the peripheral frame meeting at a central hub. The interior 72 of the shade is open throughout its height. At points adjacent the top edge 53 of the shade 30 are tabs 54 having a hole 55 through which a locking device 56 protrudes. Locking device 56, as shown in FIG. 8, in the embodiment illustrated has an upper hollow shaft 57 and a lower body portion 58 with a diameter wider than the upper shaft 57 and the hole 55. One of the plurality of support means 33, a wire in the embodiment shown, is passed through the upper hollow shaft 57 and through the lower body portion 58 and then may be locked in place so it can not pull back through the locking device 56 unless released. In FIG. 7 three tabs 54, located equidistant around the shade, and three locking devices 56 are shown. Where four support means are required four tabs and locking devices are provided.

Figure 8A:
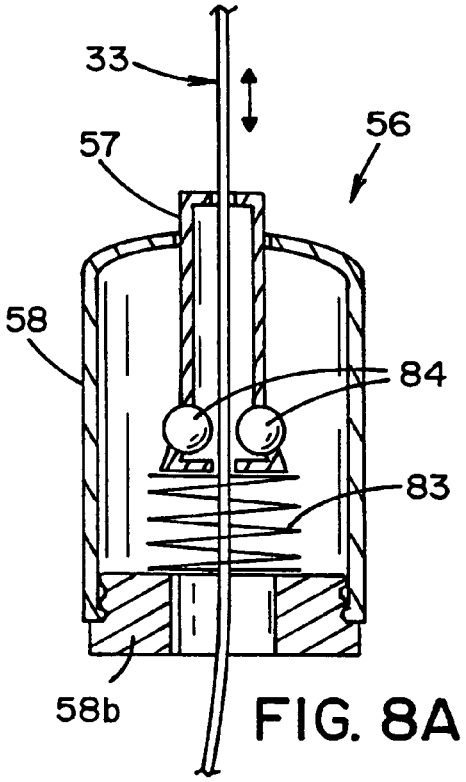
FIG. 8A shows an enlarged cross-sectional view of the locking pin shown in FIG. 8 in a position for receiving a support means to the shade.
Figure 8B:
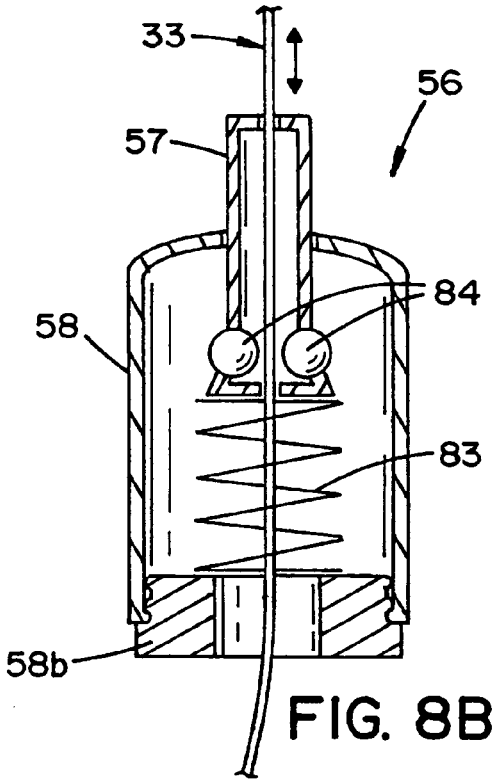
FIG. 8B shows an enlarged cross-sectional view of the locking pin shown in FIG. 8 in an intermediate position between receiving and securing a support means to the shade.
Figure 8C:
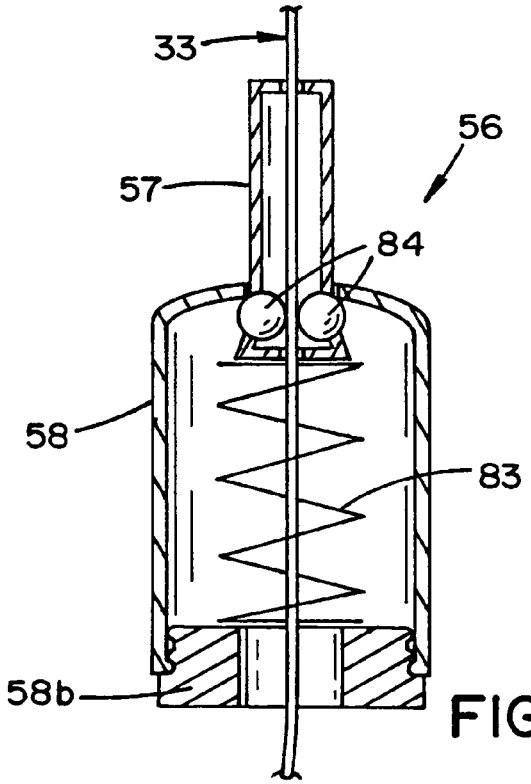
FIG. 8C shows an enlarged cross-sectional view of the locking pin shown in FIG. 8 in a securing position of a support means to the shade.

FIGS. 8A, 8B, and 8C show the typical operation of locking pin 56 securing one of the plurality of support means 33. Locking pin 56 in the embodiment shown comprises an upper hollow shaft 57, roller bearings 84 positioned through the wall of the lower region of upper hollow shaft 57, a lower body portion 58 with a removable bottom 58*b*, and a spring 83 within lower body portion 58 situated between bottom 58*b* and upper hollow shaft 57. As shown in FIGS. 8A and 8B, whilst inserting support means 33, the upper hollow shaft 57 is depressed by the installer or user towards the upper region of lower body portion 58. As upper shaft 57 compresses spring 83, support means 33 moves freely over roller bearings 84. When support means 33 is in the desired position the installer releases the pressure being applied to the upper hollow shaft 57, which causes spring 83 to move the upper shaft 57 to the locked or secured position shown in FIG. 8C. In the locked position, roller bearings 84 abut against support means 33, thereby preventing further movement of support means 33. Further adjustments of support means 33 is achieved by depressing upper shaft 57 either entirely as shown in FIG. 8A or partially as shown in FIG. 8B.

Figure 12:
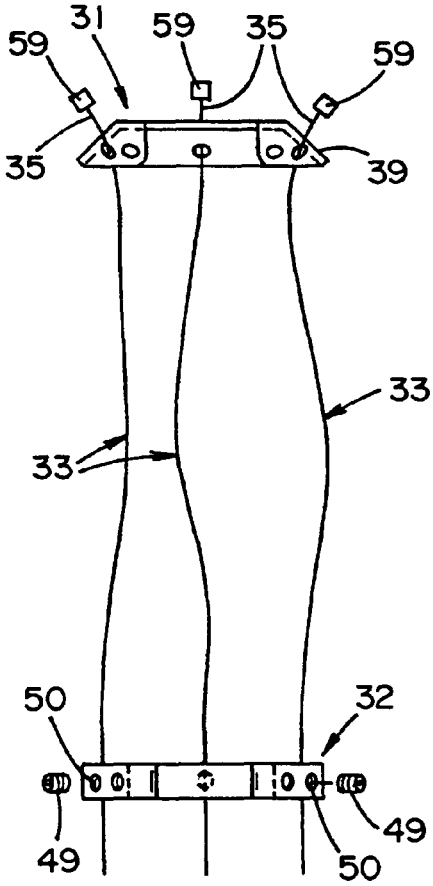
FIG. 12 shows a side view of the connection of the plurality of support means to the upper retaining means and the height adjustment means.
Figure 13:
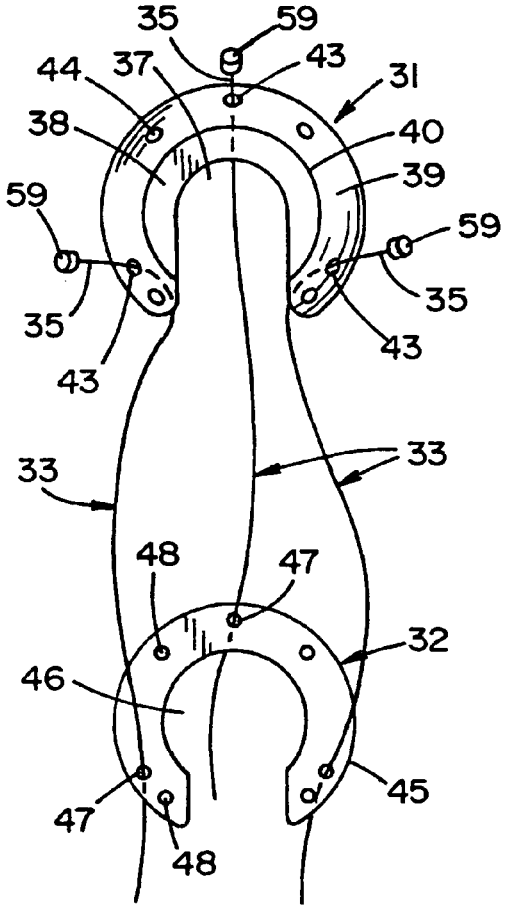
FIG. 13 shows a top view of the connection of the plurality of support means to the upper retaining means and the height adjustment means of FIG. 12.

FIGS. 12 and 13 illustrate one method by which the plurality of support means 33 can be attached to the upper retaining means 31. The end 35 of each of the support means 33 is equipped with a stop 59. A first end 34 of the plurality of support means 33 can be passed through one of the holes 43,44 in the upper retaining means 31 (from top to bottom) until stop 59 contacts the top surface of flange 39 preventing any further movement. The first end 34 of the support means 33 is then fed through one of the holes 47, 48 in the height adjust means 32. As shown in FIGS. 7 & 8, the first end 34 of the support means 33 is then passed through the locking device 57 to attach it to shade 30.

The apparatus of the present invention is not attached to the fixture 10 but connected at the canopy area as shown in FIG. 2. Therefore, there is no need to go through any of the steps associated with installation of the prior art shades to install a shade. All the installer needs to do is to loosen the top loop and or screw disc at the canopy. Care must be taken to avoid loosening the top loop so as to disconnect the fixture. The upper retaining means 31 is inserted between the canopy and the screw loop as shown in FIG. 2. The screw loop and top loop if loosened are tightened.

Next a first end 34 of the plurality of support means 33 can be passed through one of the holes 43,44 in the upper retaining means 31 (from top to bottom) until stop 59 contacts the top surface of flange 39 preventing any further movement. The first set of holes 43 is used where only three support means are required and the second set 44 used where four support means are required. For large chandeliers having a very large shade, further holes may be provided if additional supports are required.

The end 34 of each of the plurality of support means is then fed through one of the guide holes 47, 48 in the height adjust means 32. One of the screws 49 is tightened to hold the height adjustment means 32 from falling off the plurality of support means 33 during attachment of the shade 30.

The ends 34 of the plurality of support means 33, wires in the embodiment shown are attached to the shade 30 by feeding the end 34 through the locking device 56. Because the shade 30 has no spokes, it can be fitted around the fixture 10 from below. The shade is leveled by adjusting the amount of the wire 33 extending through the locking devices 56. The height adjustment means 32 fits around chain 15 and is then leveled and screws 49 tightened. The excess wire protruding through locking devices 56 can be trimmed off. Instead of taking hours to install a shade, the apparatus of the present invention takes minutes. It is safe and satisfies all CSA and/or UL standards.

The attachment of the present invention is at the canopy instead of the fixture because:

1. The upper retaining means required to hold the weight of shade is at least 6 millimeters thick;
2. Most fixtures do not have this much space to fit the upper retaining means;
3. The height adjustment means 32 can be 2 millimeters thick and is installed so its height and that of the shade can be adjustable.

The apparatus of the present invention is simple. The upper retaining means 31 is the point of attachment to the fixture. It holds a plurality of support means 33 shown as very thin steel wires in the Figs. The wires 33 fit through the height adjustment means 32 and are fastened to the sides of the shade 30.

Figure 9:
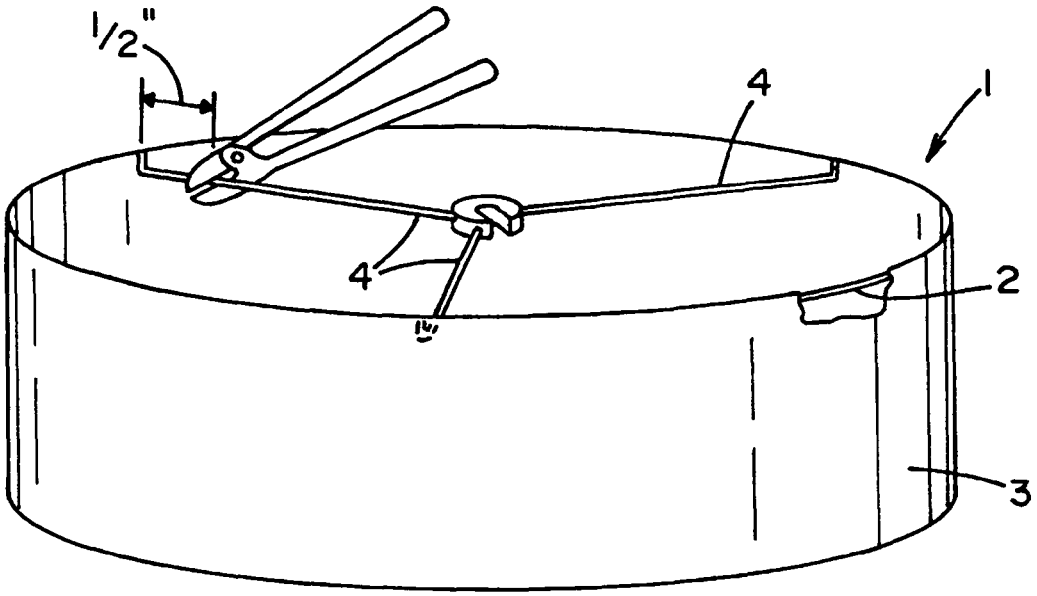
FIG. 9 shows a conventional shade being modified for use with the embodiment of the invention of FIG. 2.
Figure 10:
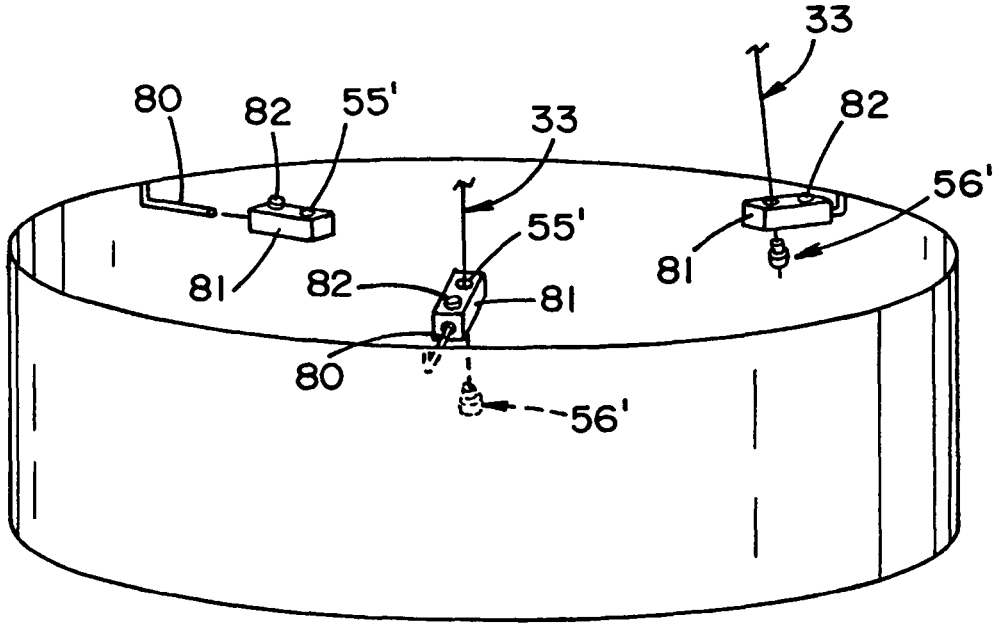
FIG. 10 shows a means for connecting a second end of each of the plurality of support means to the shade of FIG. 9.
Figure 11:
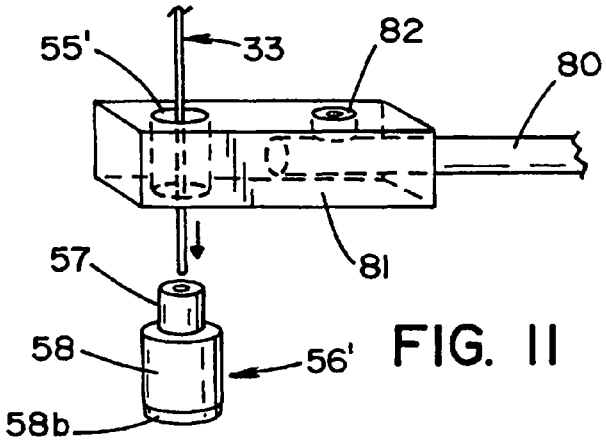
FIG. 11 shows an enlarged view of the means for connecting a second end of each of the plurality of support means to the shade of FIG. 10.

FIGS. 9 & 10 show how a prior art shade 1 of FIG. 1 can be used with the present invention. The center spokes 4 are cut off about ½ inch from the frame 2. The ends 80 of the spokes 4 are inserted into adapters 81 and screws 82 tightened to secure the adapters in place. Locking devices 56' can then be inserted in hole 55' in adapter 81. The plurality of support means 33 can then be attached to the locking devices 56' in the manner described above for locking devices 56 in FIGS. 7 & 8.

It is to be understood by one of ordinary skill in the art that the present discussion is a description of exemplary embodiments only, and is not intended to limit the broader aspects of the present invention.

Although various preferred embodiments of the present invention have been described herein in detail, it will be appreciated, by those skilled in the art that variations may be made thereto without departing from the spirit of the invention or the scope of the appended claims.

Having described the invention, the following is claimed:

1. Apparatus to attach a shade or skirt to a hanging light fixture, the apparatus comprising:

an upper retaining means attachable around a portion of the fixture connecting the fixture to a junction box in a ceiling without the need to detach the fixture from the ceiling and/or to disassemble a body of the fixture, the upper retaining means having a peripheral wall defining a centrally disposed U-shaped opening open through a side of the peripheral wall, the peripheral wall of the upper retaining means having a flat, three quarters moon shaped section and a depending peripheral flange extending around an outer edge of the three quarters moon shaped section and a plurality of holes extending through said peripheral wall for attachment to one end of each of a series of guide wires;

a height adjustment means; and the series of guide wires having another end connected to the shade or skirt, said shade or skirt having a covered peripheral frame defining an open interior.

2. Apparatus according to claim 1 wherein the height adjustment means has a peripheral wall defining a centrally disposed opening and is sized and shaped to fit around a chain connecting the fixture to the ceiling; and wherein a plurality of guide holes is provided in the peripheral wall and through which the series of guide wires pass.

3. Apparatus according to claim 2 wherein the peripheral wall of the height adjustment means is generally circular and the opening has a U-shaped cross-section open through a side of the peripheral wall.

4. Apparatus according to claim 3 wherein screws in screw holes in a side wall of the peripheral wall of the height adjustment means that open in to the guide holes can be tightened to lock the height adjustment means in the desired location on the series of guide wires.

5. Apparatus according to claim 1 wherein the interior of the shade is open throughout a height thereof and wherein at points adjacent a top edge of the shade are tabs each having a locking device for securement of the series of guide wires to the shade.

6. A method of attaching a shade or skirt to a hanging light fixture without the need to detach the fixture from a ceiling and/or to disassemble a body of the fixture, the fixture connected to a junction box in the ceiling by means of a chain having one end attached to a screw loop threaded over the end of a threaded rod projecting through a canopy and the other end of the threaded rod secured to the junction box, the other end of the chain connected to a fixture loop on the top of the light fixture, the method including the following steps:

(a) providing an apparatus comprising:

an upper retaining means attachable around a portion of the fixture connecting the fixture to the junction box in the ceiling without the need to detach the fixture from the ceiling and/or to disassemble the body of the fixture, the upper retaining means having a peripheral wall defining a centrally disposed U-shaped opening open through a side of the peripheral wall, the peripheral wall of the upper retaining means having a flat, three quarters moon shaped section and a depending peripheral flange extending around an outer edge of the three quarters moon shaped section and a plurality of holes extending through said peripheral wall for attachment to one end of each of a series of guide wires;

a height adjustment means; and the series of guide wires having another end connected to the shade or skirt, said shade or skirt having a covered peripheral frame defining an open interior;

(b) loosening the screw loop slightly to permit the upper retaining means to be inserted between the screw loop and a bottom surface of the canopy where the threaded rod fits into the opening in the peripheral wall then tightening the screw loop;

(c) a first end of each of the series of guide wires is passed through one of the plurality of holes in the upper retaining means and a second end of the series of guide wires is secured to the upper retaining means;

(d) the first end of each of the series of guide wires is then fed through one of a plurality of guide holes on the height adjustment means;

(e) the first end of the series of guide wires is attached to the shade positioned to encircle the light fixture, wherein the shade has a peripheral frame covered with fabric defining an interior of the shade, the interior of the shade is open throughout its height so it can be placed in position around the light fixture without detaching or disassembling the fixture and wherein at points adjacent a top edge of the shade are means for securement of the first end of the series of guide wires to the shade; and (f) then leveling the shade and leveling and positioning the height adjustment means to position the shade at the desired location relative to the light fixture.

7. Apparatus to attach a shade or skirt to a hanging light fixture, the apparatus comprising:

an upper retaining means attachable around a portion of the fixture connecting the fixture to a junction box in a ceiling without the need to detach the fixture from the ceiling and/or to disassemble a body of the fixture;

a plurality of support means each having one end connected to the upper retaining means and another end connected to the shade or skirt, said shade or skirt including a covered peripheral frame defining an open interior; and a height adjustment means comprising:

a generally circular peripheral wall defining a centrally disposed opening that has a U-shaped cross-section open through a side of the peripheral wall, the opening being sized and shaped to fit around a chain connecting the fixture to the ceiling, a plurality of guide holes extends through the peripheral wall and is dimensioned to allow the plurality of support means to pass therethrough, and screws in screw holes in a side wall of the peripheral wall of the height adjustment means, the screw holes dimensioned and positioned to open into the plurality of guide holes such that the screws can be tightened to lock the height adjustment means in the desired location on the plurality of support means.

8. Apparatus according to claim 7 wherein the interior of the shade is open throughout a height thereof and wherein at points adjacent a top edge of the shade are tabs each having a locking device for securement of the plurality of support means to the shade.

* * * * *